US005248315A

United States Patent [19]

Gatti et al.

[11] Patent Number: 5,248,315

[45] Date of Patent: Sep. 28, 1993

[54] DETERGENT ADDITIVE FOR FUELS

[75] Inventors: Emilio Gatti, Milan; Paolo Koch, Melegnano; Antonio Tontodonati, Milanese, all of Italy

[73] Assignee: Euron S.p.A., Milan, Italy

[21] Appl. No.: 23,869

[22] Filed: Feb. 26, 1993

Related U.S. Application Data

[63] Continuation of Ser. No. 792,249, Nov. 14, 1991, abandoned.

[30] Foreign Application Priority Data

Nov. 15, 1990 [IT] Italy ..... 22072 A/90

[51] Int. Cl.[5] ..... C10L 1/22

[52] U.S. Cl. ..... 44/387; 558/265; 558/276

[58] Field of Search ..... 44/387; 558/265, 276

[56] References Cited

U.S. PATENT DOCUMENTS

| | | | |
|---|---|---|---|
| 2,885,274 | 5/1959 | Heisler et al. | 44/387 |
| 2,887,452 | 5/1959 | Alpert et al. | 44/387 |
| 2,921,955 | 1/1960 | Newman et al. | 44/387 |
| 3,322,812 | 5/1967 | Brotherton et al. | 558/265 |
| 3,574,576 | 4/1971 | Honnen et al. | 44/432 |
| 3,649,229 | 3/1972 | Otto | 44/347 |
| 3,676,089 | 7/1972 | Morris et al. | 44/347 |
| 3,873,278 | 3/1975 | Polss | 44/408 |
| 4,160,648 | 7/1979 | Lewis et al. | 44/387 |
| 4,198,306 | 4/1980 | Lewis | 252/51.5 R |
| 4,247,301 | 1/1981 | Honnen | 44/334 |

*Primary Examiner*—Ellen M. McAvoy
*Attorney, Agent, or Firm*—Shea & Gould

[57] ABSTRACT

Detergent additive for liquid fuels, obtained by means of the trans-esterification of a tertiary amine bearing at least two hydroxy functions, with a dialkyl carbonate and a higher aliphatic alcohol, and process for preparing said detergent additive.

20 Claims, No Drawings

DETERGENT ADDITIVE FOR FUELS

This application is a continuation of Ser. No. 07/792,249, filed on Nov. 14, 1992, now abandoned.

The present invention relates to an additive for liquid fuels, in particular gasolines, which additive is endowed with detergent properties, and to the process for preparing it.

To this additives, the task is committed, in internal combustion engines operating on the basis of either Otto or Diesel cycle, of keeping their feed systems clean and free from deposits and fouling, which otherways would reduce their internal boring and would hinder the movements of the parts to which their regulation is committed, with their functional effectiveness and energy efficiency being impaired.

From the prior art some classes of compounds are known, which are used either atone or as mixtures, as detergent additives for fuels. For example, from U.S. Pat. No. 3,676,089 the alkenylsuccinimides of polyamines; from U.S. Pat. No. 3,574,576, the polyamines substituted with polyisobutylene groups; from U.S. Pat. No. 3,649,229 the Mannich bases of polyisobutenylphenols; from U.S. Pat. No. 4,160,648 polyoxyalkylene aminocarbamates; from U.S. Pat. No. 4,198,306 polyoxyalkylene aminoesters; from U.S. Pat. No. 4,247,301 polyoxyalkylene polyamines; from U.S. Pat. No. 3,873,278 the ammonium salts of fatty polyoxyalkyleneamines and acids, are known.

Such compounds perform their task as detergents, but suffer—to various extents—from the drawback that they, inside the engine ignition or combustion chambers, create carbonaceous deposits, which result to be fouling for the hot engine parts, and do not meet the requirement of keeping clean also such parts.

Furthermore, their preparation requires multi-step synthesis processes and, oftentimes, the use of highly toxic and dangerous reactants, such as, e.g., chlorine (in U.S. Pat. No. 3,574,576); formaldehyde (in U.S. Pat. No. 3,649,229); phosgene (in U.S. Pat. No. 4,160,648); hydrochloric acid (in U.S. Pat. No. 4,247,301).

The subject-matter of the present invention is a class of detergent additives which fulfil such a function both in cold engine parts (i.e., the carburettor, conduits, injectors, intake valves, and so forth), and in hot engine parts (cylinders, pistons, exhaust valves, and so forth), which can be obtained by means of a single-step process easy to be practiced, by starting from reactants which are by far less toxic and dangerous.

In fact, the present Applicant found that the carbonic esters of higher alcohols containing a functional amino group display marked detergent properties in fuel compositions, without substantial phenomena of fouling in the hot engine parts.

A further subject-matter of the present invention is a process for preparing said aminocarbonates.

The detergent additive according to the present invention is prepared by means of the transesterification of a tertiary amine having the formula $$R'—N13\ [—(CH_2)_n—OH]_2 \qquad (I)$$

wherein n is an integer comprised within the range of from 1 to 4, and

R' is another $—(CH_2)_n—OH$ group, or an alkyl radical containing from 1 to 20 carbon atoms, with an organic carbonate of formula $$R''—O—CO—O—R'' \qquad (II)$$

wherein R'' is an alkyl group of from 1 to 4 carbon atoms or an aryl group, and with an alcohol of general formula $$R_3—OH \qquad (III)$$

where $R_3$ represents a straight or branched alkyl group (or a mixture of straight or branched alkyl groups) of from 6 to 30 carbon atoms.

The presence in $R_3$ of possible ethereal oxygen atoms does not have any substantial effects on the characteristics of the resulting product, provided that such ethereal oxygen atoms are contained within a ratio of ethereal oxygen atoms to carbon atoms of 0.5 max. According to a preferred form of practical embodiment of the present invention, the compound with general formula (I) is triethanolamine or N-butyldiethanolamine (in which n=2 and R' is hydroxyethyl or butyl), the compound with general formula (II) is dimethyl carbonate or diphenyl carbonate, the compound with general formula (III) is a mixture of linear or branched, primary aliphatic alcohols of from 7 to 26 carbon atoms—obtained, e.g., by oxo-synthesis from either linear or branched olefines and carbon oxide and by means of the dimerization of such alcohols—, or a mixture of primary alcohols containing one or more ethereal groups on their alkyl chain—obtained, e.g., as byproducts of condensation of alcohols in the processes of oxo-synthesis of alcohols from olefines and CO—, or a polyoxypropylene monoether, such as, e.g., polyoxypropylene monobutylether, with a molecular weight of not more than 1,000.

Another subject-matter of the present invention is a process for preparing said oil-soluble aminocarbonates. The reaction is preferably carried out by bringing (I)/(II)/(III) reactants into contact with one another, in a mutual molar ratio comprised within the range of from 1:3:3 to 1:10:5, preferably in ratios of round 1:5:3.5. According to an alternative form of practical embodiment of the process of the present invention, the latter is subdivided into two steps: i.e., a first reaction of (I) with the excess of (II), and a subsequent reaction of the intermediate obtained in that way, with alcohol (III). The reaction leading to the product of the present invention can be catalysed by the usual trans-esterification catalysts (sodium hydroxide, potassium hydroxide, titanium alkoxides or tin derivatives), preferably dibutyltin dilaurate.

The reaction temperature is comprised within the range of from 80° to 200° C., preferably of from 100° to 1800° C. The reaction is complete when the stoichiometric amount of R''—OH (in the case of dimethyl carbonate or diphenyl carbonate, R''—OH is methanol, or phenol, respectively) was formed from the reactants. The reaction development towards its completion is favoured by subtracting from the reaction mixture the alcohol R''—OH which is formed. For that purpose, the reaction can be favoured by azeotropically distilling off R''—OH, or with reduced pressures, and so forth, according to modalities well known in the art. The same reaction can be advantageously carried out as well in the presence of inert solvents, such as hydrocarbons, chlorinated compounds, and so forth.

The raw reaction product results to be practically free from functional —OH groups, and is prevailingly constituted by the compound of general formula (IV). With reference to the case of use of a $C_{12}$ alcohol, dimethyl carbonate and triethanolamine, the reaction scheme is as follows:

$$N{-}(CH_2{-}CH_2{-}OH)_3 + 3\ CH_3OCOOCH_3 + 3\ C_{12}{-}OH \rightarrow N{-}(CH_2{-}CH_2{-}O{-}CO{-}O{-}C_{12})_3 + 6\ CH_3OH \qquad (IV)$$

The reaction is accompanied by the appearance of minor amounts of reaction byproducts, e.g., of condensation products of two molecules of triethanolamine with one molecule of dimethyl carbonate, and so on.

A third subject-matter of the present invention is a fuel composition containing a major portion of liquid fuel, in particular gasoline, and an amount of the additive of the present invention, effective as a detergent. The additive according to the present invention results to be effective already in very small amounts; the addition of from 0.005 to 0.1% by weight, preferably of from 0.02 to 0.06% by weight, results to be sufficient.

The product obtained from the trans-esterification according to the present invention is an oil-like liquid, having a considerably high viscosity, and difficult to be handled. Due to this reason, the addition thereof to the fuels can be made easier if it is used as a solution, e.g., as a concentrate containing from 25 to 95% by weight, and preferably from 50 to 70%, of the additive, dissolved in a solvent. The solvent can be selected from among alcohols, esters, ethers, hydrocarbons acting as good solvents for the product.

According to a preferred form of practical embodiment of the present invention, as the solvent, the same type of fuel is used, to which the additive will be subsequently added, such as, e.g., gasoline, gas oil, kerosene. For example, at the end of the synthesis reaction the product is diluted, inside the same reactor, by adding to it the diluent, in the desired amount, and using the same stirring means.

The additive according to the present invention, both in concentrate form, and in its state as it is, is compatible with the other additives which are commonly used for combustibles or fuels for internal combustion engines, such as, e.g., antiknock, de-emulsifier, dispersant, antifoaming, rust-preventing additives, as normally used.

The following examples are reported for the purpose of illustrating the present invention without limiting it.

EXAMPLE NO. 1

49.5 grams (0.33 mot) of 98%-pure triethanolamine, 328 grams (1.33 mol) of "C21" alcohol-ether (alcohol-ether $C_{21}H_{44}O_2$ available from Exxon Chemicals under the designation MD-EA-21), 100 grams (1.1 mol) of dimethyl carbonate and 5 grams of dibutyltin dilaurate are charged to a reactor of 1.5 litres of capacity, equipped with heating jacket, rotary-blade stirrer, thermocouple connected with a temperature reader, dripping funnel and 10-cm-long fractionation column connected with a Claisen condenser with thermometer.

The temperature inside the reaction vessel is increased up t o approximately 115° C., by causing a heating fluid coming from a temperature-controlled bath, to circulate inside the reactor jacket. Inside the reactor, an inert atmosphere of nitrogen is maintained. The reaction proceeds with development of methanol, which is distilled off as it is formed: in fact, an azeotropic mixture of dimethyl carbonate/methanol with a composition of about 1:1, is formed. Its development is controlled by maintaining the head temperature under 650° C. As the reaction proceeds, dimethyl carbonate lost through the azeotropic mixture is replenished by adding approximately 65 g thereof through the dripping funnel, with said dimethyl carbonate being hence kept always in a slight excess in the reaction mixture.

Two hours later, the head temperature is gradually increased during 4 hours, until it reaches the value of 1850° C. This temperature value is then maintained for a further 10 hours and, after collecting 110 g of azeotropic mixture, the course of the reaction is started to be checked by I.R. analysis for the hydroxy group. The operation is completed, after about 16 hours, when the hydroxy number decreases down to values of about 10 mg of KOH/G. The reaction mixture is then purged with a nitrogen stream, by operating at the temperature of about 185° C. and with a nitrogen flow rate of 100 cc/minute, for one hour. The reaction product, hereinafter indicated to as "Additive A", is a pale yellow liquid having the following characteristics:

| | |
|---|---|
| Nitrogen content | 1.13% by weight |
| Hydroxy number (ASTM D 1957) | 7.3 mg of KOH/g |
| T.B.N. (total base number) (ASTM D 664) | 42.75 mg of KOH/g |
| Pour point (ASTM D 97) | −45° C. |
| Viscosity at 100° C. (ASTM D 445) | 11 cSt |
| Viscosity at 40° C. (ASTM D 445) | 90.8 cSt |
| Thermogravimetric analysis (carried out on a Perkin Elmer TGA7 by weighing 1.2 mg of sample, which is heated from 50° C. to 500° C. at a temperature increase rate of 10° C./minute, with a nitrogen stream flowing at a flow rate of 25 cc/minute): a loss of 100% at 350° C. is evidenced. | |

EXAMPLE NO. 2

49.5 grams of triethanolamine (0.333 mol), 200 grams (1.0 mol) of isotridecyl alcohol (a prevailingly branched alcohol obtained by oxo-synthesis from propylene tetramers, manufactured by Henkel), 100 grams (1.1 mol) of dimethyl carbonate and 3.9 grams of dibutyltin dilaurate are charged to the previously described reactor.

The reaction mixture is heated up to 115° C., and through the dripping funnel, a further 65 grams of dimethyl carbonate is added. Two hours later, the temperature is gradually increased, within an 8-hour period, up to 180° C. This temperature is maintained for a further 6 hours and, after collecting 110 grams of azeotropic mixture, the reaction course begins to be checked by means of the I.R. analysis of the raw reaction mixture. The operation is ended, after about 16 hours, when the hydroxy number decreases down to values of about 8 mg of KOH/g. Then, a mild stripping, with nitrogen, of the raw reaction mixture is started (180° C for 1 hour, with a nitrogen flow rate of 100 cc/minute). The reaction product, hereinafter indicated to as "Additive B", is a pale yellow liquid, which has the following characteristics:

| | |
|---|---|
| Nitrogen content | 1.54% by weight |
| Hydroxy number (ASTM D 1957) | 7.7 mg of KOH/g |
| T.B.N. (total base number) (ASTM D 664) | 61 mg of KOH/g |
| Pour point (ASTM D 97) | −51° C. |
| Viscosity at 100° C. (ASTM D 445) | 6.62 cSt |
| Viscosity at 40° C. (ASTM D 445) | 40.35 cSt |
| Thermogravimetric analysis (carried out as in Example N. 1: | |

-continued

| |
|---|
| loss of 100% at 335° C. |

EXAMPLE NO. 3

The effectiveness of the compounds disclosed herein, and of their mixtures, in keeping clean the intake valves of an internal combustion engine was evaluated by means of the engine rig test, by using a Mercedes M102E engine.

Characteristics of the engine:

| | |
|---|---|
| Displacement (liters) | 2.299 |
| Bore (mm) | 95.5 |
| Stroke (mm) | 80.25 |
| Max. power at 5,100 rpm* (kW) | 100 |
| Max. torque at 3,500 rpm (Nm) | 205 |

*rpm = revolutions per minute

The test time is of 60 hours, and the engine operating conditions are provided for by the "Intake Valve Cleanliness Test" method (FEV- Procedure, September 1988). An unleaded Eurosuper gasoline was used, containing 3.86% of methyl-tert.butyl-ether (MTBE), as anti-knock additive, and to which 400 p a r t s by volume per million parts by volume (ppm vol/vol) of Additive A, produced as disclosed in Example No. 1, had been added.

The gasoline has the following characteristics:

| | |
|---|---|
| Specific gravity at 15° C (ASTM D 1298) | 0.749 kg/l |
| RON (ASTM D 2699) | 96.3 |
| MON (ASTM D 2700) | 86.3 |
| FIA | |
| aromatics (ASTM D 1319) | 36% by vol |
| olefines (ASTM D 1319) | 5% by vol |
| saturated hydrocarbons (ASTM D 1319) | 59% by vol |
| Actual gums (ASTM D 381) | 2 mg/100 cc |
| Copper corrosion (ASTM D 130) | 1a |

The four intake valves of the engine were weighed before, and after the test. The difference in weight, expressed as milligrams, is indicative of the amount of deposits formed during the test. The appearance of the deposits is furthermore evaluated by means of a visual method, by comparison to standard valves. The evaluation is given as a merit rating from 1 to 10, according to the method of CRC Manual No. 5 (a merit rating 10 indicates a completely clean engine).

The test results obtained by using gasoline with Additive A added, and taking into consideration the average value from two test runs, were as follows:

| | |
|---|---|
| Average weight of the deposits | 108 mg |
| Merit rating | 8.96 |

EXAMPLE NO. 4

The detergent activity of Additive A, prepared as disclosed in Example No. 1, on the fouling of the feeding system in general (intake valves and carburettor organs) was determined by means of the engine test on an Opel Kadett 1.2 S engine. A procedure was followed, which is the one described in CEC—Coordinating European Council—F-04-A-87. A reference gasoline, as well as the same gasoline with 400 ppm (v/v) added of Additive A prepared as disclosed in Example No. 1, were used.

The test is carried out by feeding, through a system of independent carburettors, two cylinders with the gasoline without additive, and both residual cylinders with the same gasoline, containing the additive under test. The comparison of the results (valve fouling, carburettor merit ratings), relevant to the pair of cylinders fed with additive-free gasoline and to the pair of cylinders fed with gasoline with additive added, makes it possible the effectiveness of the tested additive to be evaluated.

The test results were the following:

| | Gasoline in pristine state | Gasoline with additive added |
|---|---|---|
| Intake valve fouling (mg) | 413 | 214 |
| Cleanliness merit rating (intake valves) | 6.70 | 7.90 |
| Cleanliness merit rating (throttle valve body) | 9.22 | 9.96 |
| Cleanliness merit rating (intake manifold) | 8.30 | 8.90 |
| Cleanliness merit rating (throttle valve) | 9.26 | 9.46 |

The use of the additive in question reduces by 48.2% the weight of deposits on the intake valves, relatively to the additive-free gasoline. Furthermore, the cleanliness merit ratings on carburettor organs result to be higher in the case of gasoline containing the tested additive.

We claim:

1. A process for preparing a detergent fuel additive which comprises the step of transesterifying (i) a tertiary amine having the formula $R'—N—[[—CH_2.]_n—OH]_2$ where n is 1 to 4 and R' is a $—(CH_2)_n—OH$ group or a $C_1$–$C_{20}$ alkyl group with (ii) an organic carbonate having the formula R''—O—CO—O—R'' where R'' is a $C_1$–$C_4$ alkyl group or an aryl group and (iii) with an alcohol of general formula $R_3$—OH where $R_3$ is a $C_6$–$C_{30}$ aklyl group, wherein the transesterification is carried out at a temperature of from about 80° to about 200° C. in the presence of a transesterification catalyst, and wherein the ratio of (I): (II): (III) is from about 1:3:3 to about 1:10:5.

2. The process of claim 1, wherein the amine is triethanolamine or N-butyl-diethanolamine where n is 2 and R' is hydroxyethyl or butyl.

3. The process of claim 1, wherein the organic carbonate is dimethyl carbonate or diphenyl carbonate.

4. The process of claim 1, wherein the alcohol is a mixture of linear or branched, primary $C_7$–$C_{26}$ alkphatic alcohols, or a mixture of primary alcohols containing one or more ethereal groups on their alkyl chain, or polyoxypropylene monoether.

5. The process of claim 1, wherein the alcohol is an ether-alcohol with a ratio of ethereal oxygen atoms to carbon atoms of not more than 0.5.

6. The process of claim 4, wherein the alcohol is polyoxypropyleneglycol monobutyl ether having a molecular weight of not more than 1000.

7. The process of claim 1, wherein the amine is triethanolamine or N-butyl-diethanolamine where n is 2 and R' is hydroxyethyl or butyl, wherein the organic carbonate is dimethyl carbonate or diphenyl carbonate; wherein the alcohol is a mixture of linear or branched, primary $C_7$–$C_{26}$ aliphatic alcohols, or a mixture of primary alcohols containing one or more ethereal groups on their alkyl chain, or polyoxypropylene monoether.

8. The process of claim 1, wherein the temperature is about 100°-180° C. and wherein the molar ratio of (I)/(II)/(III) is about 1:5:3.5; and wherein the transesterification catalyst is dibutyltin dilaurate.

9. The process of claim 2, wherein the temperature is about 100°-180° C. and wherein the molar ratio of (I)/(II)/(III) is about 1:5:3.5; and wherein the transesterification catalyst is dibutyltin dilaurate.

10. The process of claim 3, wherein the temperature is about 100°-180° C. and wherein the molar ratio of (I)/(II)/(III) is about 1:5:3.5; and wherein the transesterification catalyst is dibutyltin dilaurate.

11. The process of claim 4, wherein the temperature is about 100°-180° C. and wherein the molar ratio of (I)/(II)/(III) is about 1:5:3.5; and wherein the transesterification catalyst is dibutyltin dilaurate.

12. The process of claim 5, wherein the temperature is about 100°-180° C. and wherein the molar ratio of (I)/(II)/(III) is about 1:5:3.5; and wherein the transesterification catalyst is dibutyltin dilaurate.

13. The process of claim 6, wherein the temperature is about 100°-180° C. and wherein the molar ratio of (I)/(II)/(III) is about 1:5:3.5; and wherein the transesterification catalyst is dibutyltin dilaurate.

14. The process of claim 7, wherein the temperature is about 100°-180° C and wherein the molar ratio of (I)/(II)/(III) is about 1:5:3.5; and wherein the transesterification catalyst is dibutyltin dilaurate.

15. The process of claim 1, wherein the amine is triethanolamine, the organic carbonate is dimethyl carbonate, the alcohol is a $C_{21}H_{44}O_2$ alcohol-ether, and the tranesterification catalyst is dibutyltin dilaurate.

16. The process of claim 1, wherein the amine is triethanolamine, the carbonate is dimethyl carbonate, the alcohol is isotridecyl alcohol, and the catalyst is dibutylin dilaurate.

17. The process of claim 1, further comprising the step of azeotropically distilling off the alcohol R''—OH as it is formed.

18. A process for preparing a detergent fuel additive, which comprises transesterifying, in the presence of a transesterification catalyst, (i) a tertiary amine having the formula $R'—N—[[—CH_2]_n—OH]_2$ where n is 1 to 4 and R' is a $—(CH_2)_n—OH$ group or a $C_1$-$C_{20}$ alkyl group with (ii) an organic carbonate having the formula R''—O—CO—O—R'' and R'' is a $C_1$-$C_4$ alkyl group or an aryl group and (iii) with an alcohol of general formula $R_3$—OH where $R_3$ is a $C_6$-$C_{30}$ alkyl group which comprises the steps of:

(a) reacting the amine with an excess of the organic carbonate to form an intermediate; and (b) reacting the intermediate with the alcohol.

19. The process of claim 18, wherein the ratio of (I):(II):(III) is from about 1:3:3 to 1:10:5.

20. The process of claim 19, wherein the temperature is about 100°-180° C. and wherein the molar ratio of (I)/(II)/(III) is about 1:5:3.5; and wherein the transesterification catalyst is dibutyltin dilaurate.

* * * * *